US012503924B2

(12) United States Patent
Bryant et al.

(10) Patent No.: US 12,503,924 B2
(45) Date of Patent: Dec. 23, 2025

(54) DOWNHOLE SETTING TOOL WITH INTEGRATED IGNITER AND METHOD OF USING SAME

(71) Applicant: GR Energy Services Management, LP, Sugar Land, TX (US)

(72) Inventors: Cameron Michael Bryant, Sugar Land, TX (US); James William Anthony, Missouri City, TX (US); Vadim Akhmadikin, Sugar Land, TX (US); Jordan Joseph Faltermeier, Houston, TX (US)

(73) Assignee: GR Energy Services Management, LP, Sugar Land, TX (US)

( * ) Notice: Subject to any disclaimer, the term of this patent is extended or adjusted under 35 U.S.C. 154(b) by 0 days.

(21) Appl. No.: 18/566,550

(22) PCT Filed: Jun. 1, 2022

(86) PCT No.: PCT/US2022/031839
§ 371 (c)(1),
(2) Date: Dec. 1, 2023

(87) PCT Pub. No.: WO2022/256452
PCT Pub. Date: Dec. 8, 2022

(65) Prior Publication Data

US 2024/0254847 A1 Aug. 1, 2024

Related U.S. Application Data

(60) Provisional application No. 63/195,540, filed on Jun. 1, 2021.

(51) Int. Cl.
*E21B 23/04* (2006.01)
*E21B 43/1185* (2006.01)

(52) U.S. Cl.
CPC ..... *E21B 23/0414* (2020.05); *E21B 43/1185* (2013.01)

(58) Field of Classification Search
CPC ..... E21B 23/0414; E21B 43/1185
See application file for complete search history.

(56) References Cited

U.S. PATENT DOCUMENTS 2,409,811 A 10/1946 Taylor et al.
2,705,159 A 3/1955 Pfau
(Continued)

OTHER PUBLICATIONS

GR Energy Services, ZipSet Setting Tool, GR-PUB031-20180103, dated Jan. 3, 2018, p. 1.
(Continued)

*Primary Examiner* — Shane Bomar
(74) *Attorney, Agent, or Firm* — JL Salazar

(57) ABSTRACT

A setting tool fora downhole tool includes a setting housing, a setting assembly, and an integrated igniter. The setting housing has a passage therethrough. The setting assembly is positioned in the passage, and includes a drive portion and a deployment portion. The drive portion has an elongate body with a propellant chamber. The deployment portion has an opening defining a drive cavity shaped to slidingly receive an end of the drive portion. The deployment portion includes a deployment end connectable to the downhole component. The integrated igniter is positioned in the propellant chamber, and includes an integrator housing, an internal propellant, and a switch assembly connected to the internal propellant. Upon triggering the switch, the internal propellant is ignited to release an ignition fluid under ignition pressure to move the deployment portion and the downhole component connected thereto to an activated position.

22 Claims, 14 Drawing Sheets

(56) References Cited

U.S. PATENT DOCUMENTS

| | | | | |
|---|---|---|---|---|
| 3,024,843 | A | 3/1962 | Vaughan | |
| 3,062,292 | A | 11/1962 | Lowrey et al. | |
| 3,211,222 | A | 10/1965 | Myers | |
| 3,713,393 | A | 1/1973 | O'Connor et al. | |
| 3,966,236 | A | 6/1976 | Vann | |
| 4,776,393 | A | 10/1988 | Forehand et al. | |
| 5,242,201 | A | 9/1993 | Beeman | |
| 5,984,006 | A | 11/1999 | Read et al. | |
| 6,095,583 | A | 8/2000 | Beeman et al. | |
| 6,431,269 | B1 | 8/2002 | Post et al. | |
| 6,450,541 | B1 | 9/2002 | Bakke | |
| 6,520,089 | B1 | 2/2003 | Avanci et al. | |
| 7,198,101 | B2 | 4/2007 | McGarian et al. | |
| 7,409,987 | B2 | 8/2008 | Fjelde | |
| 7,810,569 | B2 | 10/2010 | Hill et al. | |
| 8,267,012 | B2 | 9/2012 | Peeters et al. | |
| 8,960,093 | B2 | 2/2015 | Preiss et al. | |
| 9,581,422 | B2 | 2/2017 | Preiss et al. | |
| 9,605,937 | B2 | 3/2017 | Eitschberger et al. | |
| 9,810,035 | B1 * | 11/2017 | Carr | E21B 23/065 |
| 9,822,596 | B2 | 11/2017 | Clemens et al. | |
| 9,822,618 | B2 | 11/2017 | Eitschberger | |
| 9,915,513 | B1 | 3/2018 | Zemla et al. | |
| 10,036,236 | B1 | 7/2018 | Sullivan et al. | |
| 10,309,199 | B2 | 6/2019 | Eitschberger | |
| 10,365,079 | B2 | 7/2019 | Harrington et al. | |
| 10,507,433 | B2 | 12/2019 | Eitschberger et al. | |
| 10,626,689 | B2 | 4/2020 | Moyes | |
| 10,689,931 | B2 | 6/2020 | Mickey et al. | |
| 10,760,384 | B2 | 9/2020 | Schmidt et al. | |
| 10,794,122 | B2 * | 10/2020 | Kitchen | E21B 23/00 |
| 10,844,678 | B2 | 11/2020 | Mickey et al. | |
| 10,858,919 | B2 | 12/2020 | Anthony et al. | |
| 11,073,005 | B2 | 7/2021 | Schmidt et al. | |
| 11,078,763 | B2 * | 8/2021 | Anthony | E21B 43/117 |
| 12,123,273 | B1 * | 10/2024 | Roach | E21B 29/04 |
| 2004/0134667 | A1 | 7/2004 | Brewer et al. | |
| 2006/0048940 | A1 | 3/2006 | Hromas et al. | |
| 2006/0070739 | A1 | 4/2006 | Brooks et al. | |
| 2013/0008669 | A1 | 1/2013 | Deere et al. | |
| 2014/0033939 | A1 | 2/2014 | Priess et al. | |
| 2015/0247368 | A1 | 9/2015 | Clemens et al. | |
| 2015/0345922 | A1 | 12/2015 | Lanclos et al. | |
| 2016/0047199 | A1 * | 2/2016 | Hardesty | E21B 33/1208 166/57 |
| 2016/0061572 | A1 | 3/2016 | Eitschberger et al. | |
| 2016/0115753 | A1 | 4/2016 | Frazier et al. | |
| 2016/0356132 | A1 | 12/2016 | Burmeister et al. | |
| 2017/0030693 | A1 | 2/2017 | Preiss et al. | |
| 2017/0074078 | A1 | 3/2017 | Eitschberger | |
| 2018/0038208 | A1 | 2/2018 | Eitschberger | |
| 2018/0080298 | A1 | 3/2018 | Covalt et al. | |
| 2018/0224260 | A1 | 8/2018 | Zemla et al. | |
| 2018/0258724 | A1 | 9/2018 | Massey et al. | |
| 2018/0299239 | A1 | 10/2018 | Eitschberger et al. | |
| 2019/0016969 | A1 | 1/2019 | Kandel et al. | |
| 2019/0086189 | A1 | 3/2019 | Eitschberger et al. | |
| 2019/0106969 | A1 * | 4/2019 | Sullivan | E21B 43/1185 |
| 2019/0127290 | A1 | 5/2019 | Löhken et al. | |
| 2019/0178045 | A1 | 6/2019 | Frazier et al. | |
| 2019/0234189 | A1 | 8/2019 | Preiss | |
| 2019/0242209 | A1 | 8/2019 | Anthony et al. | |
| 2019/0242222 | A1 | 8/2019 | Eitschberger | |
| 2019/0277103 | A1 | 9/2019 | Wells et al. | |
| 2019/0330947 | A1 | 10/2019 | Mulhern et al. | |
| 2019/0376775 | A1 | 12/2019 | Preiss et al. | |
| 2020/0024935 | A1 | 1/2020 | Eitschberger et al. | |
| 2020/0032601 | A1 * | 1/2020 | Nguyen | C06B 25/34 |
| 2020/0048996 | A1 | 2/2020 | Anthony et al. | |
| 2020/0063537 | A1 | 2/2020 | Langford et al. | |
| 2020/0072029 | A1 | 3/2020 | Anthony et al. | |
| 2020/0182025 | A1 | 6/2020 | Brady | |
| 2020/0256166 | A1 | 8/2020 | Knight et al. | |
| 2020/0277837 | A1 | 9/2020 | Hern et al. | |
| 2020/0362652 | A1 * | 11/2020 | Eitschberger | E21B 23/04 |
| 2021/0040805 | A1 | 2/2021 | Kehoe et al. | |
| 2021/0047903 | A1 | 2/2021 | Albert | |
| 2021/0123311 | A1 | 4/2021 | Rosenthal | |
| 2022/0145732 | A1 | 5/2022 | Anthony et al. | |
| 2024/0035347 | A1 * | 2/2024 | Zakharia | E21B 23/042 |
| 2024/0254846 | A1 * | 8/2024 | Bryant | E21B 23/0414 |
| 2024/0254847 | A1 | 8/2024 | Bryant et al. | |
| 2024/0254848 | A1 * | 8/2024 | Bryant | E21B 23/0414 |
| 2024/0254849 | A1 * | 8/2024 | Bryant | E21B 33/12 |

OTHER PUBLICATIONS

PCT International Search Report and Written Opinion dated Aug. 25, 2022, pp. 1-14.

SA Office Action dated at least as early as Feb. 24, 2024 with translation, pp. 1-12.

* cited by examiner

DOWNHOLE SETTING TOOL WITH INTEGRATED IGNITER AND METHOD OF USING SAME

CROSS-REFERENCE TO RELATED APPLICATIONS

This application claims the benefit of U.S. Provisional Application No. 63/195,540, the entire contents of which is hereby incorporated by reference herein to the extent not inconsistent with the present disclosure. Applicant also filed U.S. Provisional Application Nos. 63/195,521; 63/195,551; and 63/222,578 on the same date as the present application, the entire contents of each of which are hereby incorporated by reference herein to the extent not inconsistent with the present disclosure.

BACKGROUND

The present disclosure relates generally to oilfield technology. More specifically, the present disclosure relates to downhole tools and downhole activators.

Wellsite operations are performed to locate and access subsurface targets, such as valuable hydrocarbons. Drilling equipment is positioned at the surface and downhole drilling tools are advanced into the subsurface formation to form wellbores. Once drilled, casing may be inserted into the wellbore and cemented into place to complete the well. Once the well is completed, production tubing may be deployed through the casing and into the wellbore to produce fluid to the surface for capture.

During the wellsite operations, various downhole tools, may be deployed into the earth to perform various procedures, such as measurement, perforation, injection, plugging, etc. Examples of downhole tools are provided in US Patent/Application No. 10200024935; U.S. Pat. No. 10,507,433; 20200277837; 20170376775; 20170330947; 20170576775; 20170530947; 20190242222; 20190234189; 10309199; 20190127290; 20190086189; 20190242209; 20180299239; 20180224260; 9915513; 20180038208; U.S. Pat. Nos. 9,822,618; 9,605,937; 20170074078; U.S. Pat. No. 9,581,422; 20170030693; 20160556132; 20160061572; U.S. Pat. No. 8,960,093; 20140033939; U.S. Pat. Nos. 8,267,012; 6,520,089; 20160115753; 20190178045; U.S. Pat. Nos. 10,365,079; 10,844,678; and 10,365,079, the entire contents of which are hereby incorporated by reference herein to the extent not inconsistent with the present disclosure. These downhole tools may be activated to perform the various procedures. Example procedures are provided in U.S. Pat. Nos. 11,078,763; 10,858,919; 10,036,236; 10,365,079; 7,409,987; 6,431,269; 3,713,393; 3,024,843; 2022/0145732; 2004/0134667; 20200072029; 20200048996; 20150345922; and 20160115753, the entire contents of which are hereby incorporated by reference herein to the extent not inconsistent with the present disclosure.

Despite advancements in downhole technology, there remains a need for efficient techniques for reliably setting and/or activating downhole tools, even in harsh and/or compact downhole environments. The present disclosure is directed at providing such needs.

SUMMARY

In at least one aspect, the disclosure relates to a setting tool for setting a downhole component of a downhole tool comprising a setting housing, a setting assembly, and an integrated igniter. The setting housing is connectable to the downhole tool. The setting housing has a passage therethrough. The setting assembly is positioned in the passage. The setting assembly comprises a drive portion and a deployment portion. The drive portion has an elongate body with a propellant chamber therein. The deployment portion has an elongate body with an opening at a driver end thereof defining a drive cavity shaped to slidingly receive an end of the drive portion therein. The deployment portion comprises a deployment end. The deployment end is connectable to the downhole component for movement therewith. The integrated igniter is positioned in the propellant chamber. The integrated igniter comprises an integrator housing, a switch assembly, and an internal propellant. The switch assembly is operatively connected to the internal propellant whereby, upon triggering the switch, the internal propellant is ignited to release an ignition fluid under ignition pressure to move the deployment portion and the downhole component connected thereto to an activated position.

In another aspect, the disclosure relates to a downhole tool, comprising a downhole component and a setting tool for setting the downhole component. The setting tool comprises a setting housing connectable to the downhole tool. The setting housing has a passage therethrough. The setting assembly is positioned in the passage. The setting assembly comprises a drive portion and a deployment portion. The drive portion has an elongate body with a propellant chamber therein. The deployment portion has an elongate body with an opening at a driver end thereof defining a drive cavity shaped to slidingly receive an end of the drive portion therein. The deployment portion comprises a deployment end. The deployment end is connectable to the downhole component for movement therewith. The integrated igniter is positioned in the propellant chamber. The integrated igniter comprises an integrator housing, a switch assembly, and an internal propellant. The switch assembly is operatively connected to the internal propellant whereby, upon triggering the switch, the internal propellant is ignited to release an ignition fluid under ignition pressure to move the deployment portion and the downhole component connected thereto to an activated position.

In yet another aspect, the disclosure relates to a method of setting a downhole component of a downhole tool, comprising: positioning an integrated igniter into a setting tool, the integrated igniter comprising an integrator housing, a switch assembly, and a propellant; positioning the setting tool about a plugging tool of the downhole tool; positioning the downhole tool in a wellbore; and deploying the plug against a wall of a wellbore by activating the setting tool with the integrated igniter by: sending a trigger signal from the surface to the switch assembly such that the propellant is ignited and releases pressurized fluid into the setting tool thereby shifting the setting tool and the plugging tool connected thereto to an activated position.

In at least one aspect, the disclosure relates to a setting tool for setting a downhole component of a downhole tool. The setting tool comprises a setting housing; a setting assembly; and an integrated igniter. The integrated igniter has an internal propellant or an external propellant.

In another aspect, the disclosure relates to a downhole tool comprising a downhole component; and a setting tool with an integrated igniter for setting the downhole component. The downhole component may comprise a plug assembly.

In another aspect, the disclosure relates to a method of activating a setting tool of a downhole tool. The method comprises positioning an integrated igniter into a setting tool; positioning the setting tool about the downhole tool;

positioning the downhole tool in a wellbore; and triggering the integrated igniter to ignite a propellant in the setting tool.

Finally, in another aspect, the disclosure relates to a method of setting a downhole component of a downhole tool. The method comprises positioning an integrated igniter into a setting tool; positioning the setting tool about a plug assembly of the downhole tool; positioning the downhole tool in a wellbore; and deploying a plug of the plug assembly by activating the setting tool with the integrated igniter.

In at least one aspect, the present disclosure relates to an igniter for activating a downhole component of a downhole tool. The igniter comprises an igniter housing; a switch assembly; and a propellant. The switch assembly may comprise a single or dual switch. The propellant may be positioned outside of or within the igniter housing.

In another aspect, the present disclosure relates to a downhole tool comprising a downhole component, and an igniter for activating the downhole component. The igniter comprises an igniter housing; a switch assembly; and a propellant. The igniter may be an integrated igniter positioned within the downhole component, or a remote igniter positioned outside the downhole component.

The downhole tool may be a setting tool. The setting tool may be activated by inserting the igniter into the setting tool; deploying the setting tool with the integrated igniter into the wellbore; triggering the integrated igniter by passing a trigger signal from a surface unit to the switch assembly such that the switch assembly ignites the propellant to release a gas into the setting tool with sufficient force to advance a piston in the setting tool and deploy a plug assembly.

Finally, in another aspect, the disclosure relates to a method of activating a downhole component of a downhole tool, such as a release tool, a setting tool, or other downhole component. The method comprises positioning the igniter about the downhole tool; positioning the downhole tool in the wellbore; and triggering the igniter.

This Summary is not intended to be limiting and should be read in light of the entire disclosure including text, claims and figures herein.

BRIEF DESCRIPTION OF THE DRAWINGS

So that the above recited features and advantages of the present disclosure can be understood in detail, a more particular description of the invention, briefly summarized above, may be had by reference to the embodiments thereof that are illustrated in the appended drawings. The appended drawings illustrate example embodiments and are, therefore, not to be considered limiting of its scope. The figures are not necessarily to scale and certain features, and certain views of the figures may be shown exaggerated in scale or in schematic in the interest of clarity and conciseness.

DETAILED DESCRIPTION

Figure 1:
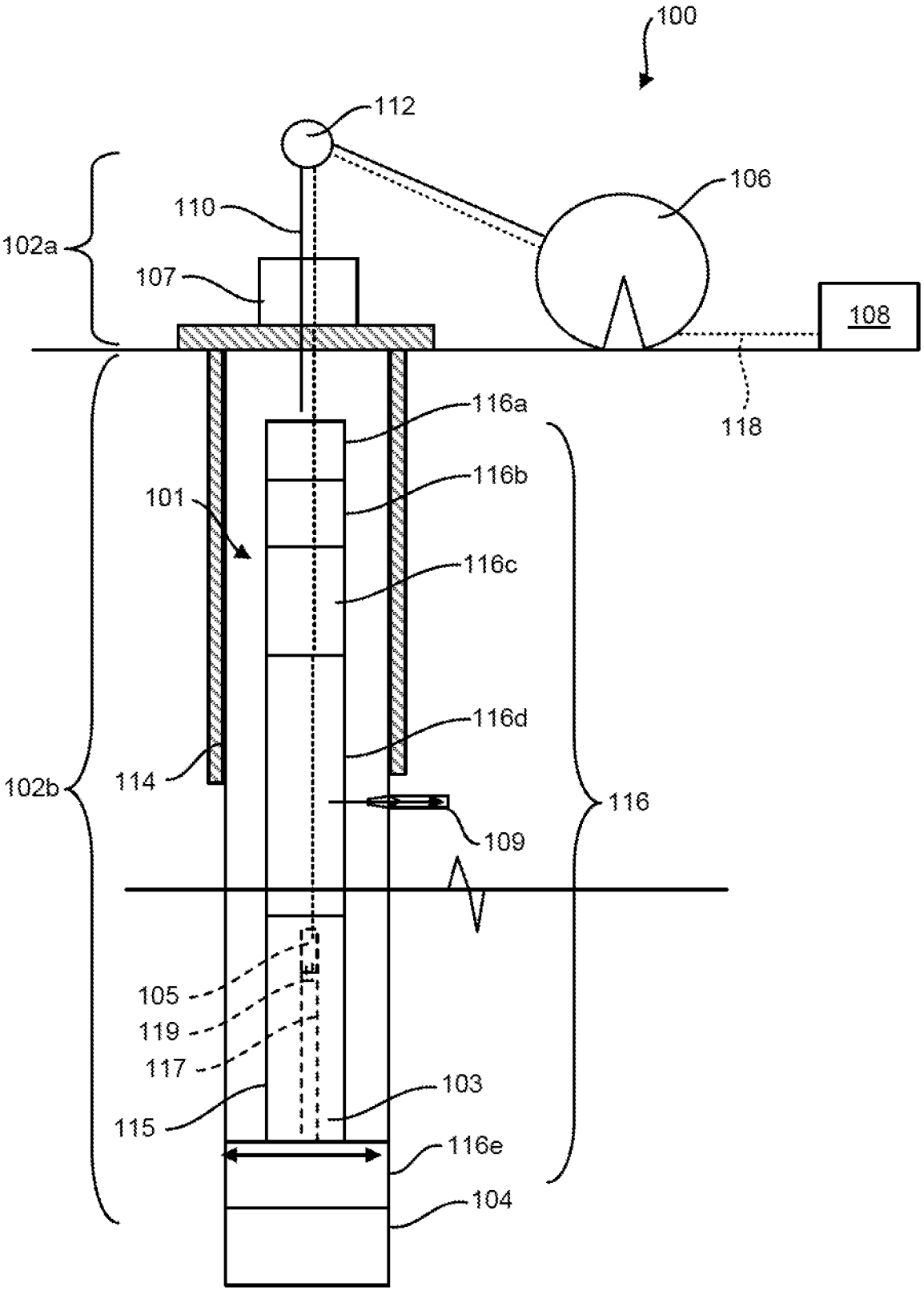
FIG. 1 is a schematic view of a wellsite with surface and downhole equipment, the downhole equipment comprising a downhole tool including a setting tool with an integrated igniter.

The description that follows includes exemplary apparatus, methods, techniques, and/or instruction sequences that embody techniques of the present subject matter. However, it is understood that the described embodiments may be practiced without these specific details.

This disclosure relates to a setting tool for setting downhole components of a downhole tool positionable in a wellbore at a wellsite. The setting tool may include an integrated activator (e.g., integrated igniter) and a setting assembly. The integrated activator may be triggered to activate the setting tool, and cause the setting assembly to set (e.g., shift, alter, drive, deploy, move, etc.) a downhole component. For example, the integrated activator may be triggered from the surface to ignite a propellant within the setting tool which drives a piston to deploy a plug assembly, thereby anchoring the downhole tool in the wellbore.

The setting tool may be a downhole component used to set one or more other downhole components. The combination of multiple downhole components formed into one assembly (e.g., a tool string) is referred to as a 'downhole tool.' The downhole tool may be a modular assembly including various combinations of multiple downhole components, such as a cable release, a collar locator, weight bars, a perforating tool (gun), a release tool, a setting tool, a plugging tool, an electronics hub, etc. One or more downhole components may be included in a single housing, or in separate housings of the downhole tool. The downhole components may be operatively (e.g., electrically and/or mechanically) connected together. One or more of the downhole components may operate separately or in concert.

The integrated igniter may be positioned within (e.g., integrated into) the setting tool to enable pre-assembly of the setting tool with the integrated activator therein, to provide close proximity of the integrated igniter to the setting assembly for efficient use therewith, to enable quick connection/disconnection of the setting tool and the integrated activator with the downhole tool, to provide a compact structure for use in restricted downhole spaces, etc. The integrated igniter may also be removably positioned within the setting tool to enable repair, replacement, and/or reuse of various integrated activators (e.g., igniters). The integrated igniter may be replaced with the same integrated igniter, or another type of integrated activator. This configuration may be used to provide a unitary setting tool (with the integrated igniter pre-assembled therein) connectable to the downhole tool for use therewith.

The setting tool may be coupled to various downhole components (e.g., a plug assembly) for activation thereof. The setting tool may also be provided with various configurations, such as various types of igniters or other activators (e.g., a single use, dual use, etc.) and various configurations of propellants (e.g., internal or external to the igniter, disc shaped, cylindrically shaped, etc.).

The present disclosure seeks to include one or more of the following features, among others: interchangeability with various tools, reduction in downtime, reduction in lost equipment, reliability, ballistic activation, operability in harsh downhole conditions, ease of manufacture and assembly, ability to couple to or integrate with existing components, operability with components of other tools for use therewith, reduction in cost, increased efficiency, elimination of redundant components, flexibility of use, ability to change configurations to match operational needs, ability to provide one or more activations, time savings, efficient operation, low maintenance costs, compact design, replaceable and/or disposable components, etc.

FIG. 1 is a schematic view of a wellsite 100 with surface equipment 102*a* and downhole equipment 102*b*, the downhole equipment 102*b* comprising a downhole tool 101 including a setting tool 103 and an integrated igniter 105. The surface equipment 102*a* and the downhole equipment 102*b* are positioned about a wellbore 104 at the wellsite 100. The wellsite 100 may be any wellsite positioned about a subterranean formation, such as an unconventional formation (e.g., shale) with a reservoir (e.g., oil, gas, water, etc.) therein.

The surface equipment 102*a* includes a conveyance reel 106, and a surface unit 108. The surface equipment 102*a* may include a wellhead 107 (and other surface components) positioned about the top of the wellbore 104. The conveyance reel 106 may be a spool rotationally mounted at the surface. The conveyance reel 106 supports a conveyance 110 as it is deployed into the wellbore 104. A pulley 112 may optionally be provided to support the conveyance 110 about the wellbore 104 as schematically shown. In the example of FIG. 1, the conveyance 110 is a wireline cable electrically and communicatively coupled between the surface unit 108 and the downhole tool 101 for passing signals therebetween.

The downhole equipment 102*b* comprises the downhole tool 101 positioned in the wellbore 104 and supported therein by the conveyance 110. The wellbore 104 may have a casing 114 therein to line a surface of the wellbore 104. The downhole tool 101 may be deployed through the casing and into an open portion of the wellbore 104 via the conveyance 110 for performing downhole operations. The downhole tool 101 is provided with various downhole components 116 for performing such downhole operations.

FIG. 1 shows an example configuration of the downhole tool 101 that may be used with the igniter 105. In this example, the downhole tool 101 includes several downhole components 116 connected together to form a tool string. The downhole components 116 in this example include a cable head 116*a*, weight bars 116*b*, a collar locator 116*c*, a perforating tool 116*d*, a setting tool 103, and a plug assembly 116*e*. Various arrangements of one or more of the downhole components 116*a-e* (and/or other downhole components 116, such as a release tool, electronics sub, etc. (not shown)) may be provided.

The downhole components 116 as shown are used to perform various downhole operations. The cable head 116*a* may operatively connect the downhole tool 101 to the conveyance 110. The weight bars 116*b* may be provided to add weight to the downhole tool 101. The collar locator 116*c* may be used to locate portions of the casing 114, or other items along the wellbore 104. As schematically shown, the perforating tool 116*d* may be used to launch shaped charges to form perforations 109 along the wall of the wellbore 104. Examples of perforating tools are provided in U.S. Pat. No. 10,036,236; 20200072029; and 20200048996, previously incorporated herein.

FIG. 1 also shows an example of the setting tool 103 that may be used. As schematically shown, the setting tool 103 includes a setting housing 115, a setting assembly 117, and the integrated igniter 105. The setting assembly 117 may be coupled to the plug assembly 116*e* for use therewith. The setting assembly 117 may be activated by the integrated igniter 105 to deploy a plug from the plug assembly 116*e* (as indicated by the double arrow) to anchor the downhole tool 101 along the wellbore 104. Examples of techniques for setting and plugging are described in US Patent Application No. 20190242209; U.S. Pat. Nos. 10,365,079; 10,844,678; and 3,024,843, previously incorporated by reference herein.

One or more setting tools 103 and/or integrated igniters 105 (or other integrated activators) may be positioned in various locations about the downhole tool 101 for use with various of the downhole components 116. In the example shown, the integrated igniter 105 is an ignition device positioned in an integrated configuration within the setting tool 103 for igniting a propellant 119, thereby activating the setting tool 103 to deploy the plug assembly 116*e* as is described further herein.

The setting tool 103 and/or the integrated igniter 105 may be communicatively coupled by a communication link 118 to the surface to receive signals therefrom. In the example shown in FIG. 1, the communication link 118 extends from the surface unit 108 and to the downhole tool 101 via the conveyance 110. The communication link 118 extends through the downhole components 116 and to the integrated igniter 105. The surface unit 108 may be provided with personnel (e.g., operators) and/or electronics (e.g., central processing units (CPUs), controllers, etc.) for sending trigger signals via the communication link 118 to the integrated igniter 105. Once triggered, the integrated igniter 105 activates the setting tool 103 to deploy the plug assembly 116*e* as is described further herein.

While FIG. 1 shows a certain configuration of the wellsite 100, the surface equipment 102*a*, and the downhole equipment 102*b*, various configurations may be used. For example, one or more communication links 118, surface units 108, and/or other devices may be provided for triggering the integrated igniter 105 and activating the setting tool 103. In another example, the downhole tool 101 may have one or more downhole components 116 in use with one or more setting tools 103 and/or integrated igniters 105. It will also be appreciated that, while the descriptions herein refer to certain uphole and downhole positions, such positions may optionally be reversed.

Figure 2A:
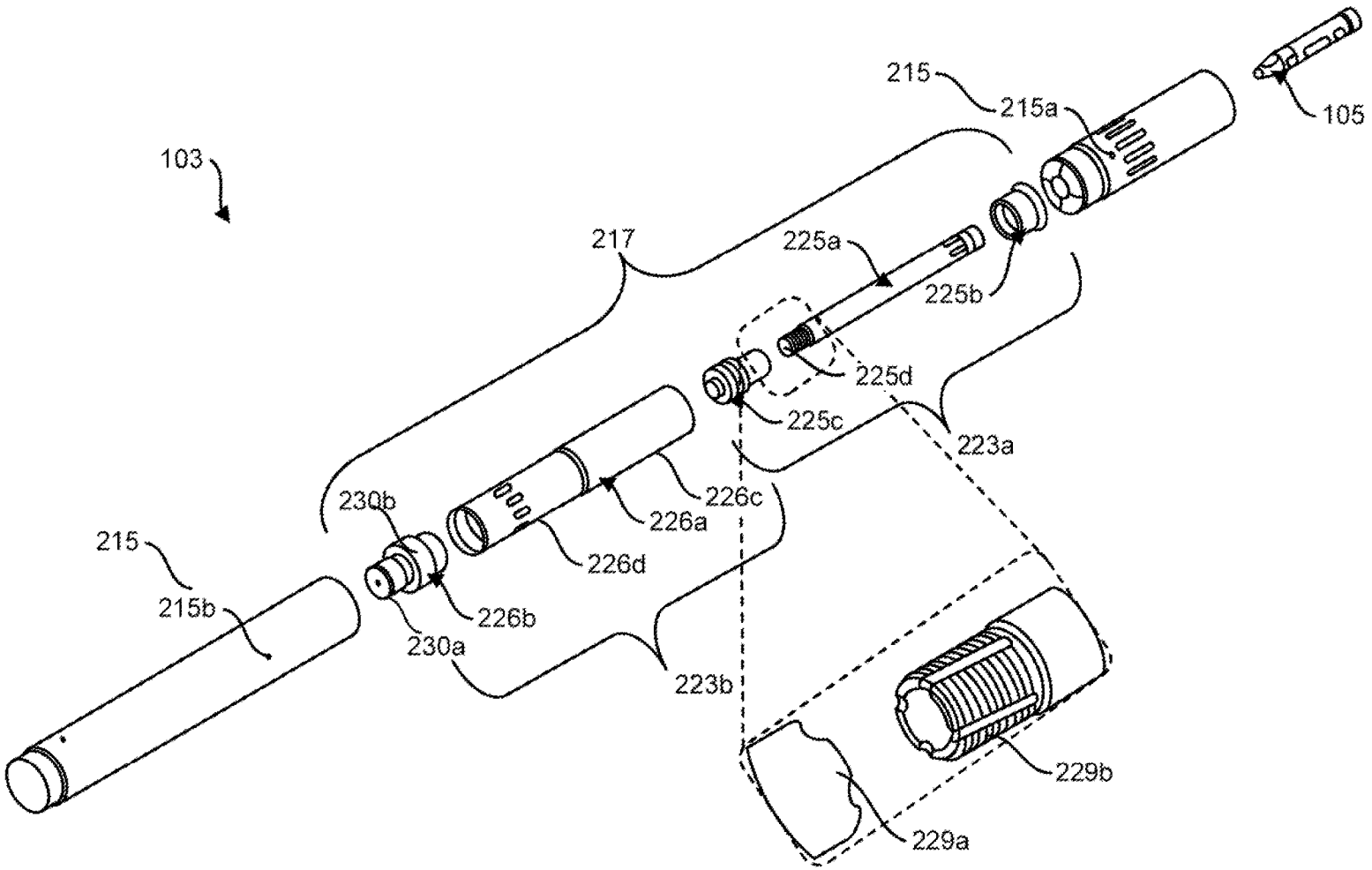
FIGS. 2A and 2B are exploded and cross-sectional views, respectively, of the setting tool.
Figure 2B:
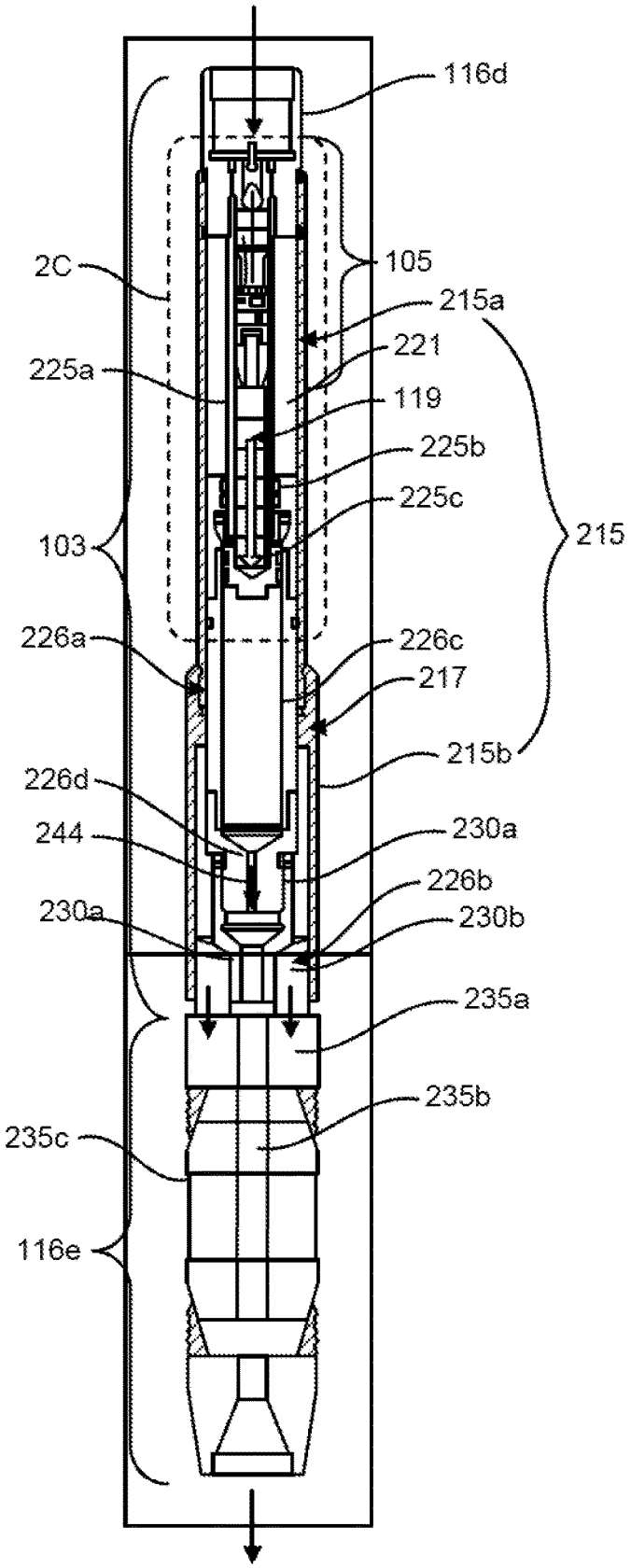
Figure 2C:
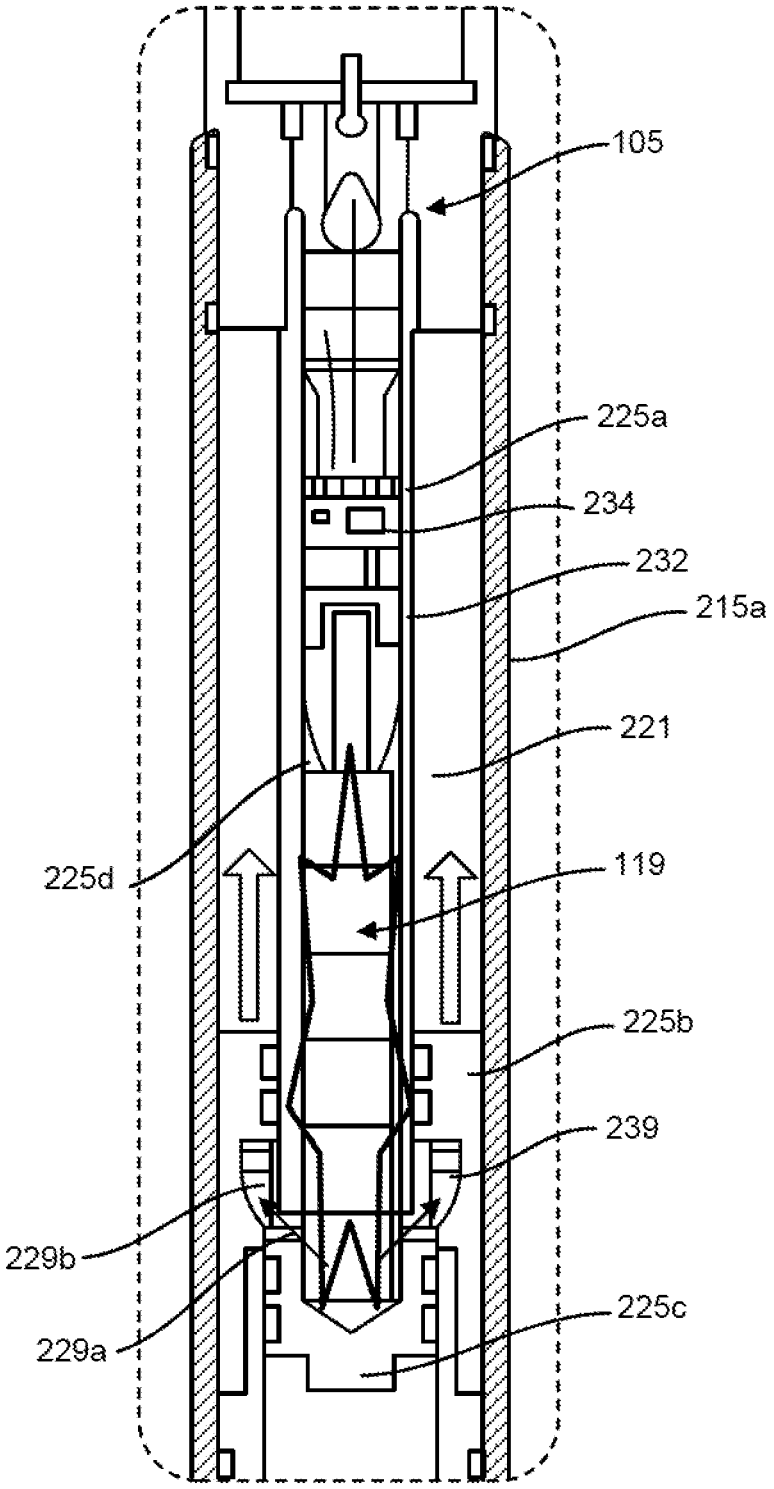
FIG. 2C shows a portion 2C of the setting tool of FIG. 2B.
Figure 3A:
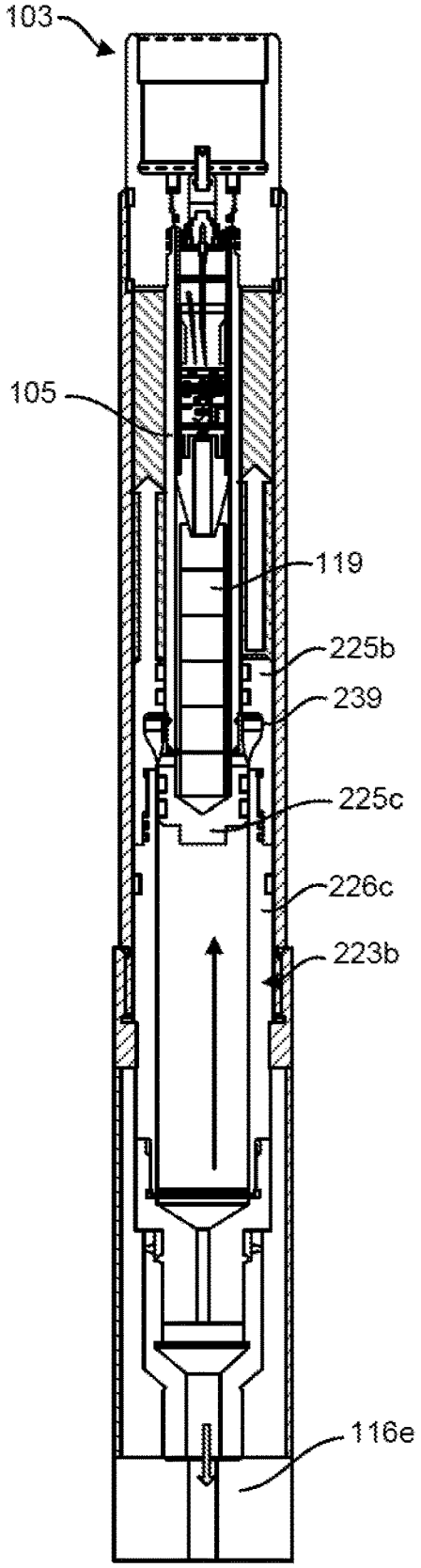
FIGS. 3A and 3B cross-sectional views of the setting tool with the integrated igniter before and after activation, respectively.
Figure 3B:
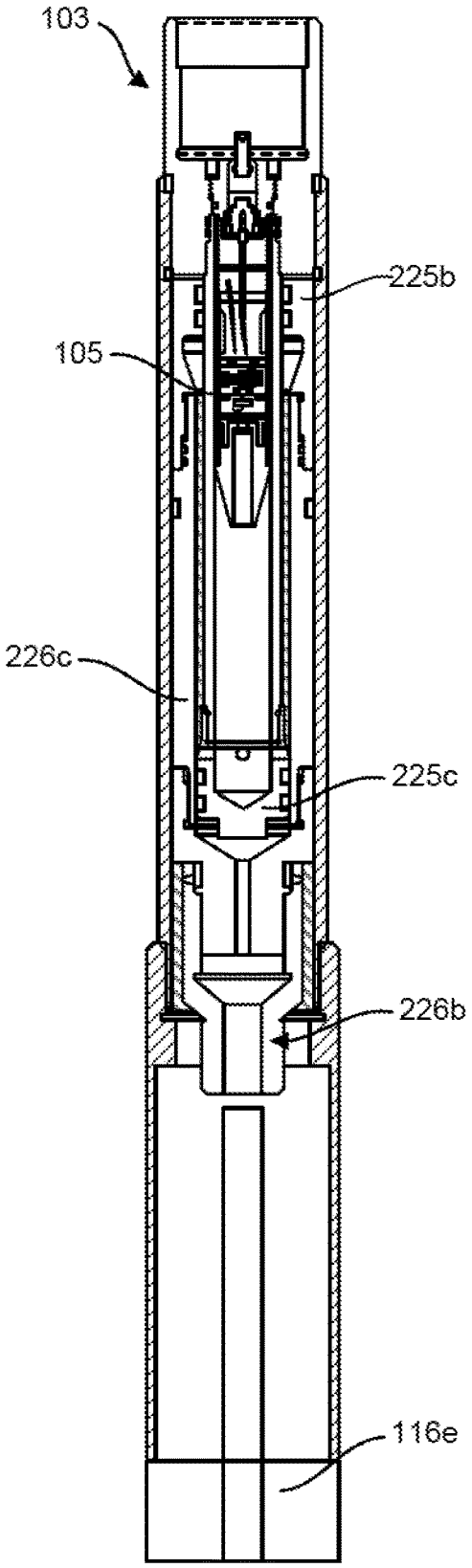

FIGS. 2A-2C and 3A-3B show various views of the setting tool 103. FIGS. 2A and 2B are exploded and cross-sectional views, respectively, of the setting tool 103. FIG. 2C shows a portion 2C of the setting tool 103 of FIG. 2B. FIGS. 3A and 3B cross-sectional views of the setting tool 103 with the integrated igniter 105 before and after activation, respectively. These figures show example configurations of the integrated igniter 105, the setting tool 103, and the plug assembly 116*e*. As shown in these figures, the integrated igniter 105 is integrated into the setting tool 103 for activation of the setting tool 103 and the plug assembly 116*e* (or other downhole component). This configuration may be used to provide a unitary setting tool 103 connectable to the perforating tool 116*d* (or other downhole component 116 (FIG. 1)).

As also shown in FIGS. 2A and 2B, the setting tool 103 includes the setting housing 215, the setting assembly 217, and the integrated igniter 105. The setting housing 215 is a tubular metal member with a passage 221 therethrough. In the example shown, the setting housing 215 includes two portions connected together (e.g., by mated threads), namely an integrated thread adapter 215*a* and an outer chamber 215*b*. An uphole end of the setting housing 215 (e.g., the integrated thread adapter 215*a*) may be connected to another downhole component 116, such as perforating tool 116*d* (FIG. 1) or a release tool (not shown). The downhole end of the setting housing 215 (e.g., the outer chamber 215*b*) is positioned between the integrated threaded adapter 215*a* and the plug assembly 116*e*, and may be connected to the plug assembly 116*e*.

The setting assembly 217 includes a drive assembly 223*a* and a deployment assembly 223*b*. The drive assembly 223*a* includes a propellant chamber rod 225*a*, a drive piston 225*b*, and a drive end 225*c*. The propellant chamber rod 225*a* is a tubular member concentrically positioned within the integrated thread adapter 215*a*. The propellant chamber rod 225*a* has a propellant chamber 225*d* therein shaped to receive the integrated igniter 105. The integrated igniter 105 may be removably positioned in the setting tool 103, and may be replaceable for multiple use operation with the setting tool 103 as is described further herein.

As shown in FIGS. 2B and 2C, the integrated igniter 105 includes an igniter housing 232, a switch assembly 234, and the propellant 119. The igniter housing 232 is a tubular member shaped for insertion into the propellant chamber 225*d*. The igniter housing 232 is also shaped to house and protect the switch assembly 234. The switch assembly 234 is positioned in the igniter housing 232 and is coupled by the communication link 118 to the surface unit 108 for receiving trigger signals (FIG. 1). The switch assembly 234 is also coupled to the propellant 119 for igniting the propellant 119. In this example, the propellant 119 is positioned external to the igniter housing 232 of the integrated igniter 105. The propellant 119 may also be positioned internally within the igniter housing 232 as is described further herein.

Referring back to FIGS. 2A-2C, the propellant chamber 225*d* is shaped to receive the integrated igniter 105 therein, and to slidingly support the drive piston 225*b* thereon. The drive piston 225*b* is a tubular shaped member concentrically positioned between the propellant chamber rod 225*a* and the integrated thread adapter 215*a*. The drive piston 225*b* is slidably positioned along an inner surface of the integrated thread adapter 215*a* and along an outer surface of the propellant chamber rod 225*a* in response to changes in fluid pressure from the propellant chamber 225*d*. The propellant chamber 225*d* is adapted to house and/or selectively release a fluid pressure generated by ignition of the propellant 119 by the integrated igniter 105, and to allow such fluid to pass to and drive the drive piston 225*b*.

The drive end 225*c* is also positioned within the integrated thread adapter 215*a* downhole from the propellant chamber rod 225*a* and the drive piston 225*b*. The drive end 225*c* is connected to a downhole end of the propellant chamber rod 225*a* to define a bottom of the propellant chamber 225*d* and to act as a downhole stop for movement of the drive piston 225*b*. As shown in the blowup detail of FIG. 2A, a vent portion 229*a* of the drive end 225*c* receives a downhole vented end 229*b* of the propellant chamber rod 225*a*.

The vented end 229*b* may be perforated to allow fluid pressure in the propellant chamber rod 225*a* to pass from the propellant chamber 225*d*, past the vent portion 229*a*, and to the drive piston 225*b*. Machine pathways may be defined along the vented end 229*b* to manipulate the flow of fluid through the propellant chamber 225*d*. The vented end 229*b* may be shaped and/or provided with helical grooves, thereby providing helical venting (or fluid flow) which allows the fluid to flow along a helical path as it passes through the propellant chamber 225*d*.

The deployment assembly 223*b* includes a deployment rod 226*a* and a deployment end 226*b*. The deployment rod 226*a* is a tubular member concentrically positioned within the outer chamber 215*b*. The deployment rod 226*a* includes a deployment chamber 226*c* and a fluid chamber 226*d*. The deployment chamber 226*c* may be connected between the drive end 225*c* and the fluid chamber 226*d*. The fluid chamber 226*d* may be connected (e.g., by threads) between the deployment chamber 226*c* and the deployment end 226*b*.

The deployment chamber 226*c* may be in fluid communication with the drive assembly 223*a* and the fluid chamber 226*d* to transfer fluid pressure therebetween. Fluid pressure received in the deployment chamber 226*c* may be applied to the fluid chamber 226*d*. The fluid chamber 226*d* may have a fluid cavity 244 with a fluid (e.g., gas) therein. Fluid pressure from the deployment chamber 226*c* may be reduced by the fluid in the fluid cavity 244, thereby cushioning movement of the setting assembly 217.

The deployment end 226*b* is slidably positioned within the outer chamber 215*b*. The deployment end 226*b* is also connected to a downhole end of the fluid chamber 226*d* and is movable therewith. The deployment end 226*b* includes a mandrel 230*a* and a slider 230*b*. The mandrel 230*a* is connected at one end to the fluid chamber 226*d* and at an opposite end to the plug assembly 116*e*. The mandrel end 230*a* has a stepped outer surface shaped to receive the slider 230*b* thereon. The mandrel 230*a* has an outer surface shaped to slidingly engage an inner surface of the outer chamber 215*b*.

The deployment end 226*b* extends from the downhole end of the setting tool 103 and is connected to the plug assembly 116*e*. The plug assembly 116*e* includes a plug base 235*a*, a plug tube 235*b*, and a plug 235*c*. The plug base 235*a* may be positioned adjacent a downhole end of the setting tool 103 adjacent the deployment end 226*b*. The plug tube 235*b* may extend through the plug base 235*a* for connection with the deployment end 226*b*. The plug tube 235*b* may be connected to the mandrel 230*a*. The fluid pressure may be transferred from the fluid cavity 244 through the mandrel 230*a* and to the plug tube 235*b*.

The plug 235*c* may be positioned about the plug base 235*a* with the plug tube 235*b* extending therethrough. The plug 235*c* may have a flexible surface that is expandable for gripping engagement with the wall of the wellbore 104 (FIG. 1). An uphole end of the plug assembly 116*e* is positioned adjacent to outer chamber 215*b* of the setting housing 215. Uphole movement of the setting assembly 217 causes the plug base 235*a* to compress along the plug tube 235*b* and to expand the plug 235*c* for engagement with the wellbore wall.

As schematically shown in FIG. 2C, upon triggering of the integrated igniter 105, the switch assembly 234 ignites the propellant 119 and releases fluid into the propellant chamber 225*d*. Fluid pressure is passed from the propellant chamber 225*d* and into a piston cavity 239 where it reaches the drive piston 225*b*. Pressure in the deployment chamber 226*c* enters the piston cavity 239 and causes uphole movement of the drive piston 225*b* as indicated by the arrows.

As shown in FIGS. 3A and 3B, the fluid pressure drives the drive piston 225*b* from its inactivated position in FIG. 3A to its activated position in FIG. 3B. The deployment assembly 223*b* is connected to the drive piston 225*b* and moves uphole with the drive piston 225*b*. As the deployment assembly 223*b* moves uphole to the activated position, the drive end 225*c* and a portion of the propellant chamber 225*d* are driven further into the deployment chamber 226*c*. The uphole movement of the deployment assembly 223*b* also causes the plug assembly 116*e* to expand.

While not shown, it will be appreciated that the setting tool 103 could also be coupled to other downhole components for activation. It will also be appreciated that, while the descriptions herein refer to certain uphole and downhole positions, such positions may optionally be reversed.

Figure 4A:
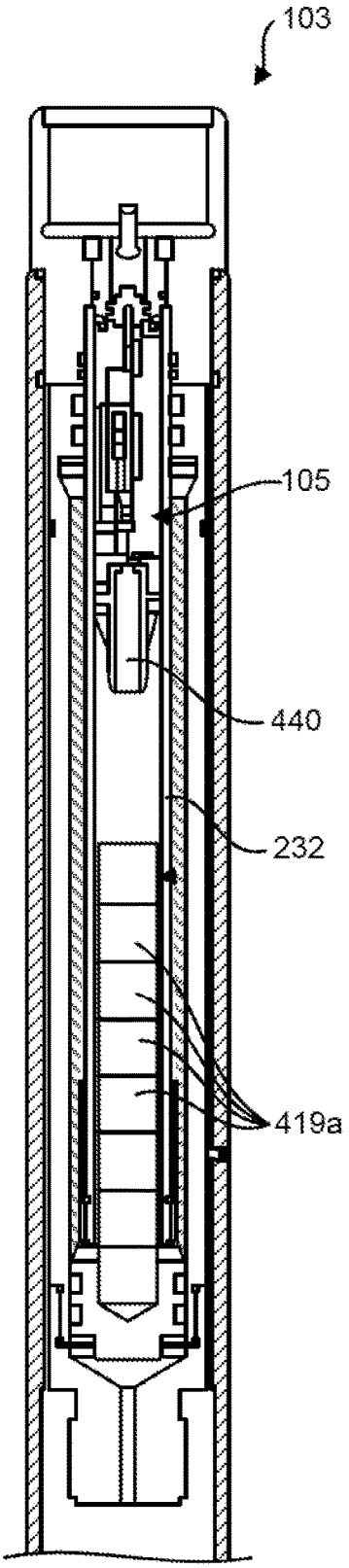
FIGS. 4A and 4B are cross-sectional views of portions of the setting tool having an integrated igniter with a disc propellant and a cylindrical propellant, respectively.
Figure 4B:
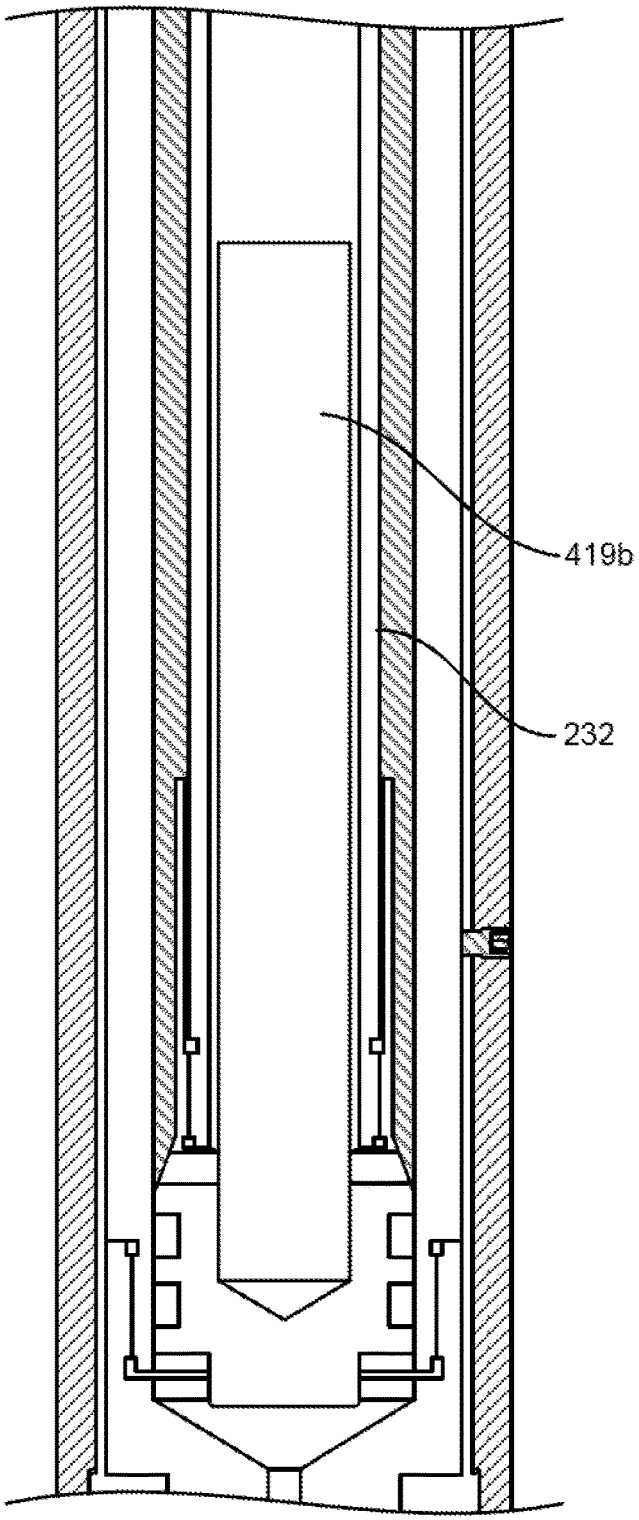

FIGS. 4A and 4B are cross-sectional views of portions of the setting tool 103 having the integrated igniter 105 with a series of propellant discs 419*a* and a cylindrical propellant 419*b*, respectively. As demonstrated by these views, the integrated igniter 105 (or other integrated activator) may employ various activators, and the various activators may have various configurations. As shown in FIG. 4A, the propellant discs 419*a* are stacked within the igniter housing 232. As shown in FIG. 4B, the cylindrical propellant 419*b* is a cylindrical, one-piece propellant positioned in the igniter housing 232. Various other configurations of the propellant may be employed, such as an internal propellant positioned internally within the igniter 105 as described further herein.

The propellants 419*a*, 419*b* may be positionable in the integrated igniter 105 and/or in the setting tool 103. The propellant 419*a*, 419*b* may be a combustible (e.g., an explosive) material ignitable by the switch assembly 234 to generate the desired pressure. In this example, the integrated igniter 105 uses propellant 419*a*, 419*b*, as an activator for generated a pressurized gas used to drive the setting assembly 217 (see, e.g., FIGS. 2A-2C). The propellant 419*a*, 419*b* may be any propellant capable of generating sufficient pressure to operate the setting tool 103 (e.g., to drive the drive piston 225*b*). As also shown in FIG. 4A, a detonator 440 may also be provided in the integrated igniter 105 for detonating the propellant. Examples of propellants and combustible materials that may be used are described in U.S. Pat. Nos. 3,713,393; 3,024,843; 20150345922, previously incorporated by reference herein.

Figure 5A:
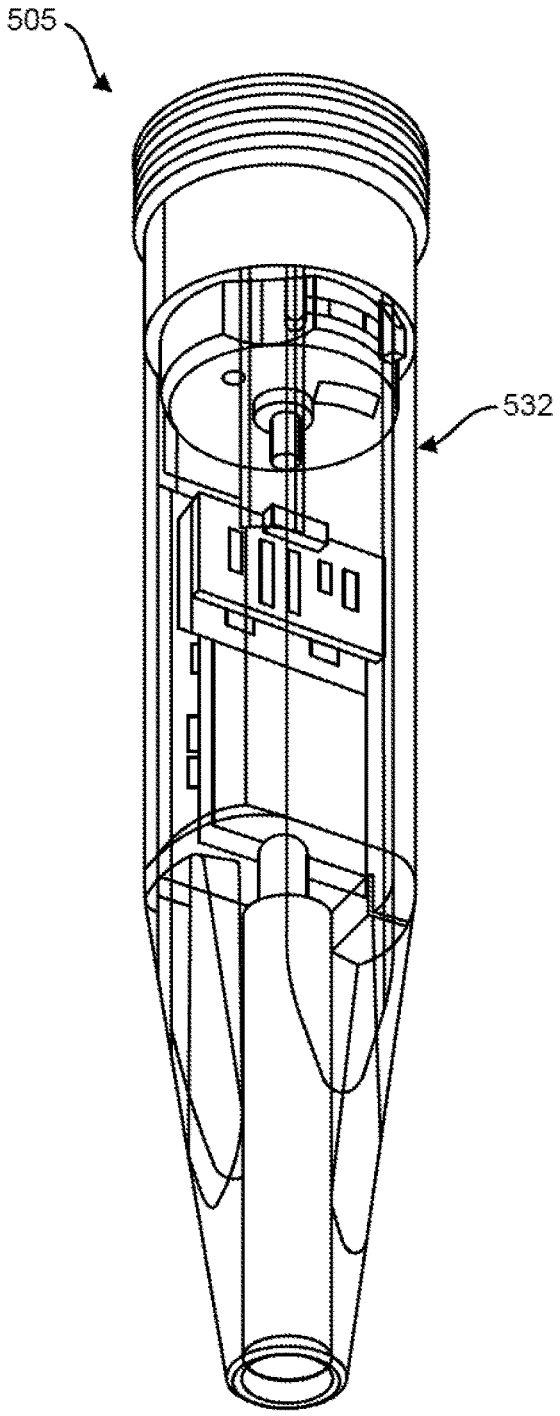
FIGS. 5A-5C are hidden, partial cross-sectional, and exploded views, respectively, of the integrated igniter with a single switch assembly.

FIGS. 5A-7C show various versions of the igniter 505, 605, and 705. Any of these versions of the igniter 505, 605, 705 may be used as the integrated igniter 105 as described herein. FIGS. 5A-5C show a single contact version of the igniter 505, and FIGS. 6A-6C show a dual contact version of the igniter 605. These versions have the internal propellant 119 in an internal position. These versions also may not require a locking or screw or support about the propellant 119.

Figure 5B:
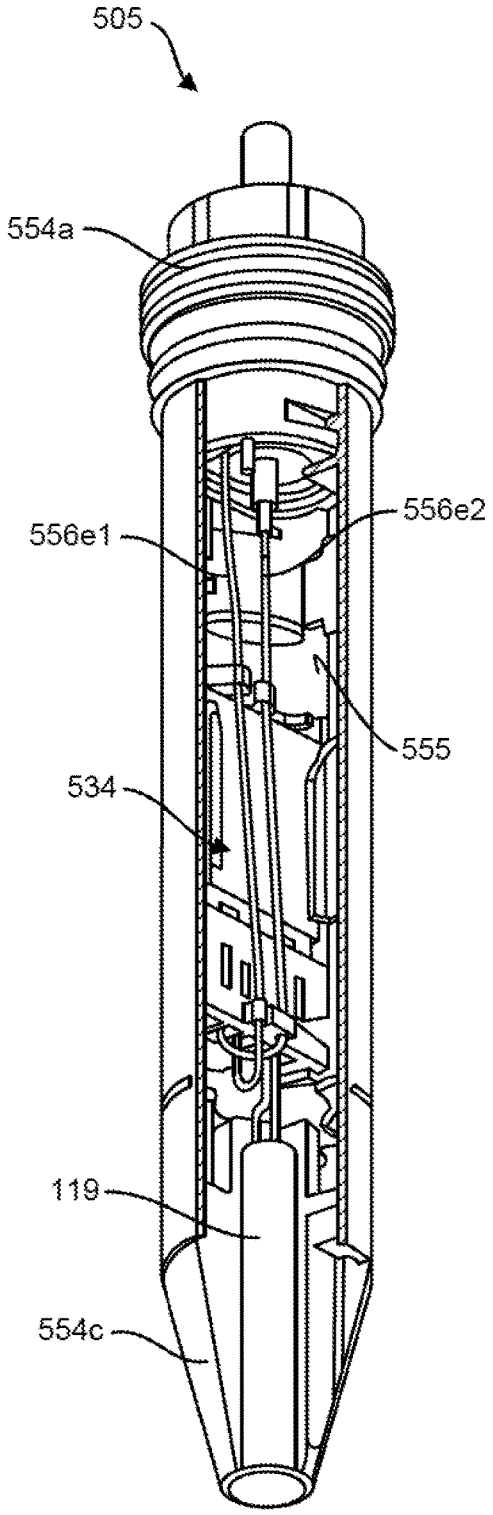
Figure 5C:
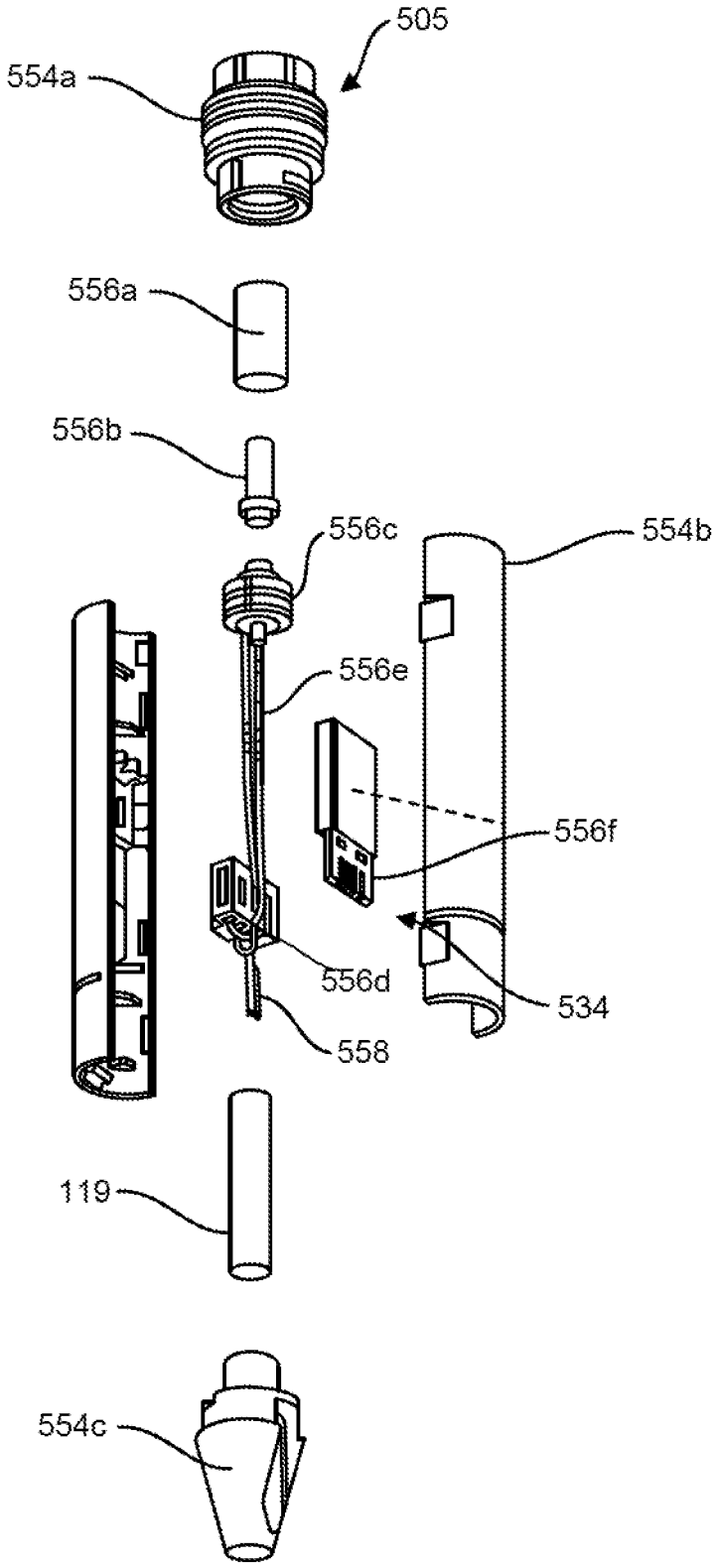

FIGS. 5A-5C are hidden, partial cross-sectional, and exploded views, respectively, of the igniter 505 with a single switch assembly 534. In this version, the igniter 505 includes an igniter housing 532, the switch assembly 534, and the internal propellant 119. The igniter housing 532 includes a bulkhead (or uphole connector) 554*a*, igniter portions 554*b*, and a nose cone 554*c*. The igniter housing 532 may be shaped for insertion into the setting housing 215 (see, e.g., FIGS. 2A-2C).

The bulkhead 554*a* is a cylindrical member with threads thereon for threaded connection to the downhole component 116 (e.g., the perforating tool 116*d* of FIG. 1). The nose cone 554*c* is a tapered member with a passage for extension of the propellant 119 therethrough. The igniter portions 554*b* are curved portions that form a tubular member when joined together. The igniter portions 554*b* are attached to the bulkhead 554*a* at one end and the nose cone 554*c* at an opposite end to form a switch chamber 555 for receiving the switch assembly 534 therein. The nose cone 554*c* may be shaped for easy removal and for easy access to the propellant 119 to facilitate replacement of the propellant 119 after use or as needed, and/or to facilitate access into the igniter 505.

The switch assembly 534 is supported within the igniter housing 532. The switch assembly 534 includes an insulator 556*a*, a plunger 556*b*, a plunger plug 556*c*, a single igniter plug 556*d*, wires 556*e*, and a single addressable switch 556*f*. The insulator 556*a* is a tubular, spring-loaded member connected to the bulkhead 554*a*. The insulator 556*a* is made of a non-conductive material to prevent electrical contact between the bulkhead 554*a* and the switch assembly 534. The plunger 556*b* is positioned in the insulator 556*a* and extends therefrom for connection to the plunger plug 556*c*.

The plunger 556*b* may be an electrical connector for connecting the switch assembly 534 to other portions of the downhole tool 101 for communication therewith. For example, the plunger 556*b* may extend through the bulkhead 554*a* for electrical connection to the perforating tool 116*d* (FIG. 1), and/or to the communication link 118. The wires 556*e* may be electrically connected to other downhole components 116, the communication link 118, the conveyance 110, the surface unit 108, etc. (FIG. 1). In this manner, the switch assembly 534 may be electrically connected to the surface for receipt of a trigger signal.

The plunger plug 556*c* is an electrical connector supported in the igniter 505. The plunger plug 556*c* is electrically connectable to the plunger 556*b* at one end, and to the single igniter plug 556*d* by the wires 556*e* at the other end. The wires 556*e* may include a ground wire 556*e*1 and a surface link wire 556*e*2. The ground wire 556*e*1 may be coupled to the bulkhead 554*a*. The surface link wire 556*e*2 may be electrically connected to the plunger 556*b*.

The single igniter plug 556*d* is an electrical connector supported in the igniter 505. The single igniter plug 556*d* is electrically connected to the addressable switch 556*f* by a plug contact 558. In this version, the addressable switch 556*f* is a single switch and the plug contact 558 is a single contact. The single addressable switch 556*f* is electrically connected with the surface unit 108 via the single igniter plug 556*d*, the wires 556*e*, and the plunger 556*b* (which is in communication with the surface unit 108 as described herein).

The single addressable switch 556*f* is also electrically connected with the propellant 119 via the plug contact 558. The propellant 119 is also positioned within the igniter housing 532. The propellant 119 is shown as a tubular member supported within the nose cone 554*c* and extendable therethrough. The propellant 119 may include one or more individual power packs of combustible material ignitable by an electrical charge applied by the addressable switch 556*f*. The single addressable switch 556*f* may be used for a single ignition of the integrated igniter 505.

Figure 6A:
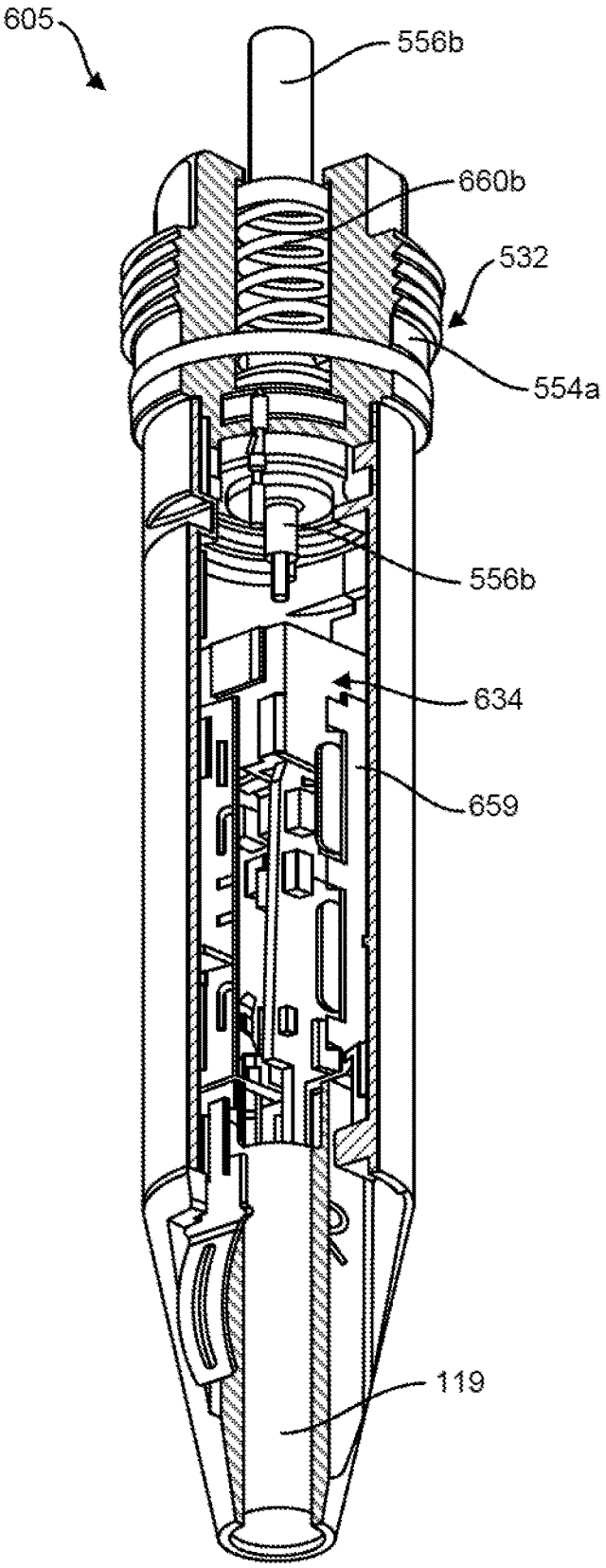
FIGS. 6A and 6B are partial cross-sectional and exploded views, respectively, of the integrated igniter with a dual switch assembly.
Figure 6B:
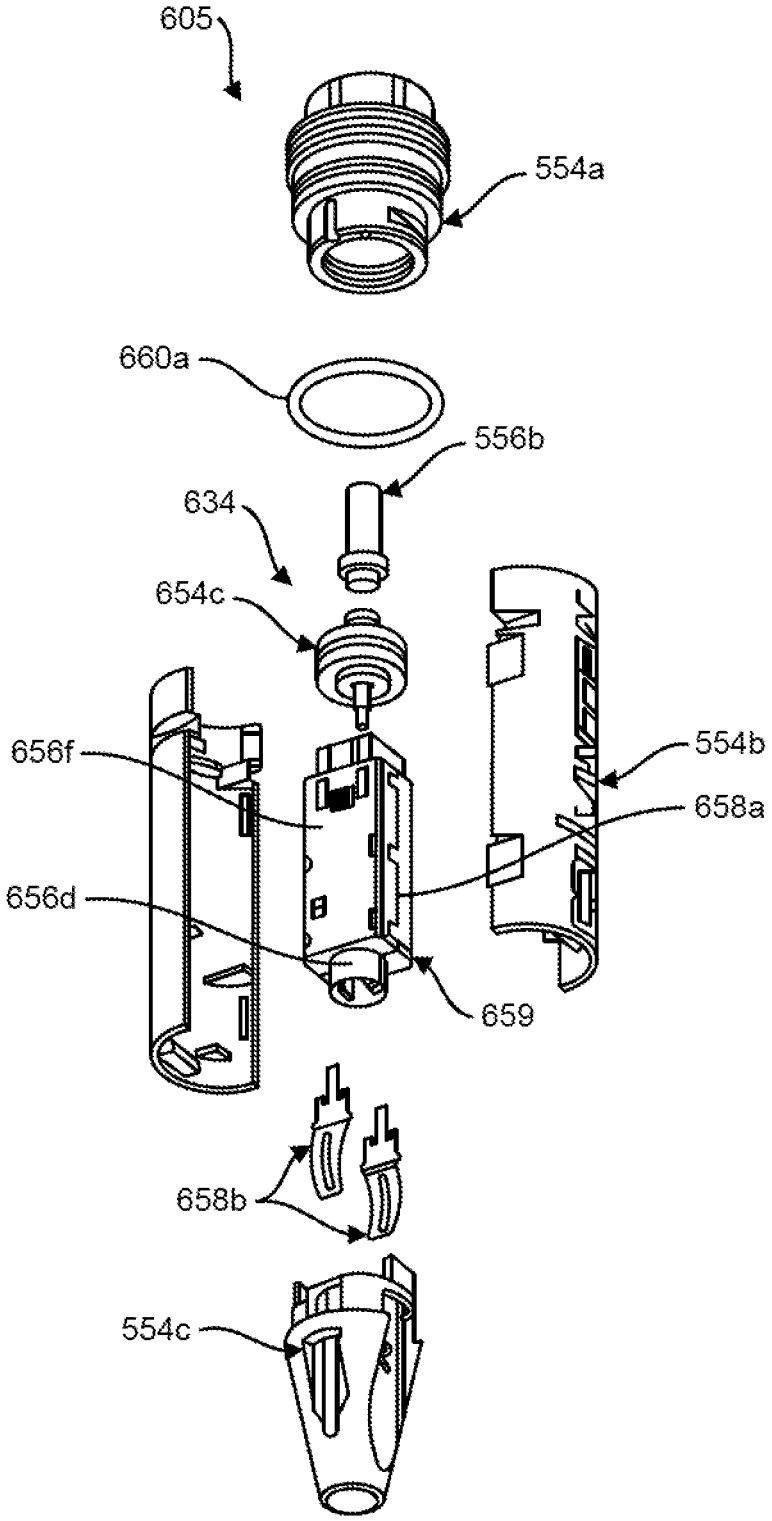

FIGS. 6A and 6B are partial cross-sectional and exploded views, respectively, of the igniter 605 with a dual switch assembly 634. This version is similar to the igniter 505 of FIGS. 5A-5C with the same igniter housing 532 (with bulkhead 554*a*, igniter portions 554*b*, and nose cone 554*c*), without an insulator 556*a*, and with a different switch assembly 634.

In this version, the dual switch assembly 634 includes the same plunger 556*b*, and wires 556*e* (as shown in FIGS. 5A-5C). This switch assembly 634 also includes a switch housing 659, an o-ring 660*a*, compression spring 660*b*, plunger plug 654*c*, a dual igniter plug 656*d*, and a dual addressable switch 656*f*. The plunger plug 654*c* includes a plunger plate 658*a* and dual plug contacts 658*b*. The o-ring 660*a* is positioned between the bulkhead 554*a* and the igniter portions 554*b*. The plunger 556*b* is supported in the bulkhead 554*a* by the compression spring 660*b*. The compression spring 660*b* is positioned within the bulkhead 554*a* between the plunger 556*b* and the plunger plug 654*c*.

The plunger plug 654*c* is an insulated feed thru supported in the igniter portions 554*b*. The switch housing 659, the plunger plug 654*c*, the dual igniter plug 656*d*, and the wires 556*e* are also supported in the igniter portions 554*b*. This switch housing 659 may enclose and/or support one or more components of the switch assembly 634 (e.g., plugs 656*d* and wires 556*e*) for easy removal and replacement after use or as needed.

The plunger plug 654*c* electrically connects the plunger 556*b* to the dual igniter plug 656*d*. The dual igniter plug 656*d* is electrically connected to the dual plug contact 658*b* and to the dual addressable switch 656*f*. The dual addressable switch 656*f* is connected to the propellant 119 by the dual plug contacts 658*b*. The addressable switch 656*f* has dual contacts 658*b* for redundant contact with the propellant 119. The dual addressable switch 656*f* may be used for a dual ignition of the integrated igniter 505. As demonstrated by this example, one or more contacts 558, 658*b* may be used to provide redundant electrical connection with the propellant 119 to further assure ignition.

Figure 7A:
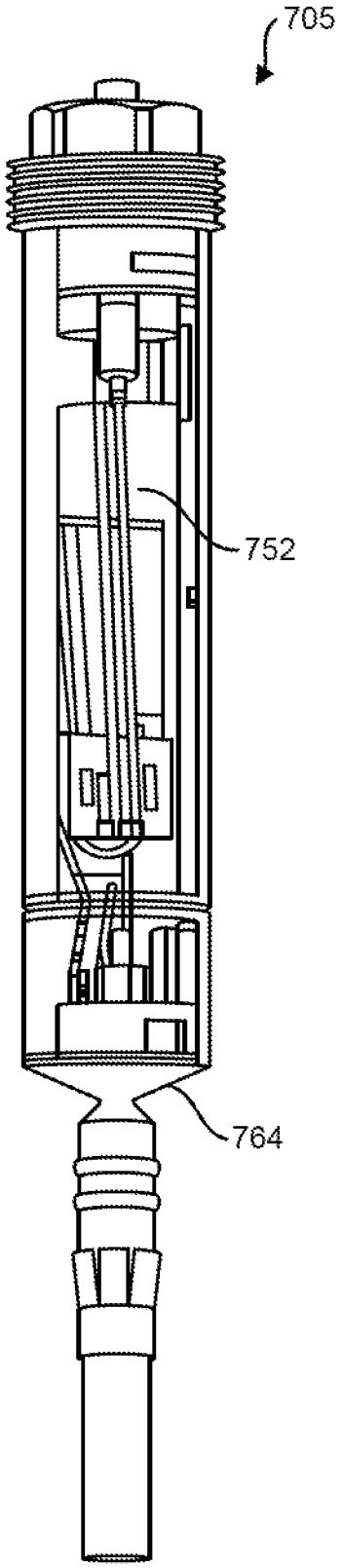
FIGS. 7A-7C are hidden, cross-sectional, and exploded views, respectively, of a locking version of the integrated igniter with a single switch assembly and an external propellant.
Figure 7B:
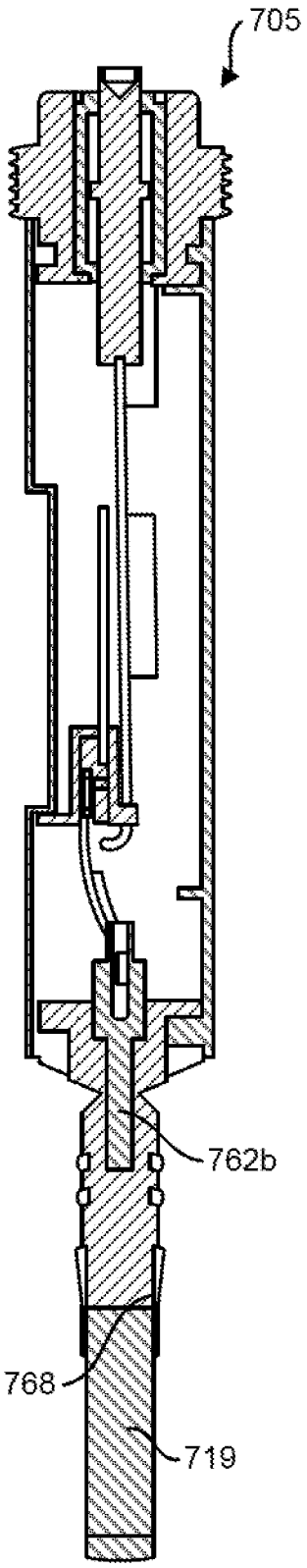
Figure 7C:
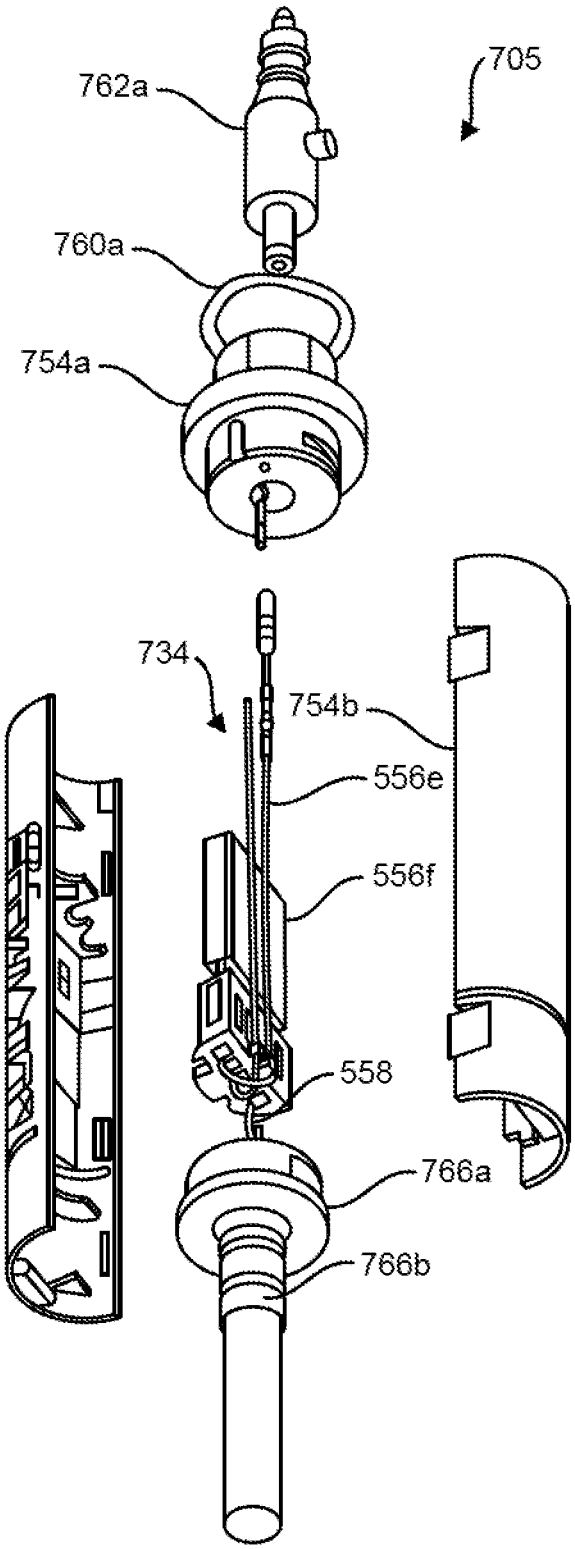

FIGS. 7A-7C are hidden, cross-sectional, and exploded views, respectively, of a locking (e.g., screw on) version of the igniter 705 with the single switch assembly 734 and an external propellant 719. This version has the propellant 719 supported by the igniter 705 in an external position outside of the igniter housing 752.

Like the integrated igniters 505 of FIGS. 5A-5C and 605 of FIGS. 6A and 6B, this version includes an igniter housing 752, the switch assembly 734, and an external propellant 719. In this version, the igniter housing 752 is a cylindrical member with the propellant 719 external thereto. A demonstrated by this version, the igniter housing 752 may have different shapes, and may support the propellant 719 external from other components housed within the igniter housing 752. The external propellant 719 may also be provided separate from the igniter 505 as shown in FIGS. 3A-3B.

In this version, the igniter housing 752 includes a bulkhead 754*a* and igniter portions 754*b*. The igniter portions 754*b* are similar to the igniter portions 554*b* of FIGS. 5A-5C. An o-ring 760*a* is positionable about the bulkhead 754*a*. The bulkhead 754*a* operates similar to the bulkheads 554*a* of FIGS. 5A-5C for communication via communication link 118 (FIG. 1).

The switch assembly 734 is positioned within the igniter portions 754*b*, and includes the same addressable switch 556*f*, single contact 558, and wires 556*e* of the switch assembly 534 of FIGS. 5A-5C. This switch assembly 734 also includes a bulkhead feedthru 762*a* and a nose feedthru 762*b*. The bulkhead feedthru 762*a* is extendable through the bulkhead 754*a*. The wires 556*e* are electrically connectable to the bulkhead feedthru 762*a* at one end and the single contact 558 at the other end. The single contact 558 is connectable to the nose feedthru 762*b*. The bulkhead feedthru 762*a* extends through the bulkhead 754*a* for connection to the wires 556*e* at one end and to another downhole component, such as the perforating tool 116*d* for communication with the conveyance 110 and the surface unit 108 (FIG. 1).

This version may also employ locking means (e.g., a locking or screw or support) about the external propellant 719. A locking ring 764 positioned at a downhole end of the igniter portions 754*b*. The propellant 719 is secured to the housing 752 by the locking ring 764, and extends from an end of the igniter housing 752 for insertion into the downhole tool (e.g., into propellant chamber 225*d* of the setting tool 103 (see, e.g., FIG. 2C)).

The locking ring 764 may be used to secure the propellant 719 to the igniter 705. The locking ring 764 is a ring-shaped member including a housing portion 766*a* and a nose portion 766*b* extending downhole therefrom. The housing portion 766*a* may be threaded for connection to the igniter portions 754*b*. The housing portion 766*a* may also have a hole to receive the nose feedthru 762*b* therethrough.

The nose feedthru 762*b* extends into the nose portion 766*b* for connection to the switch assembly 734. The nose portion 766*b* has a nose receptacle 768 for receivingly supporting the propellant 719 therein. Upon triggering of the switch assembly 734, a signal passes from the switch assembly 734 via the nose feedthru 762*b* to ignite the propellant 719, thereby activating the downhole component (e.g., activating setting tool 103 to deploy the plug assembly 116*e*).

While specific configurations of the setting tool and the integrated igniter integrated therewith are shown, it will be appreciated that various configurations of the integrated igniter and the setting tool may be provided. It will also be appreciated that each of the igniters described herein may include one or more features of the other igniters described herein. For example, one or more wires, connectors, contacts, propellants, portions of housings, shapes of components, etc. can be provided.

Figure 8A:
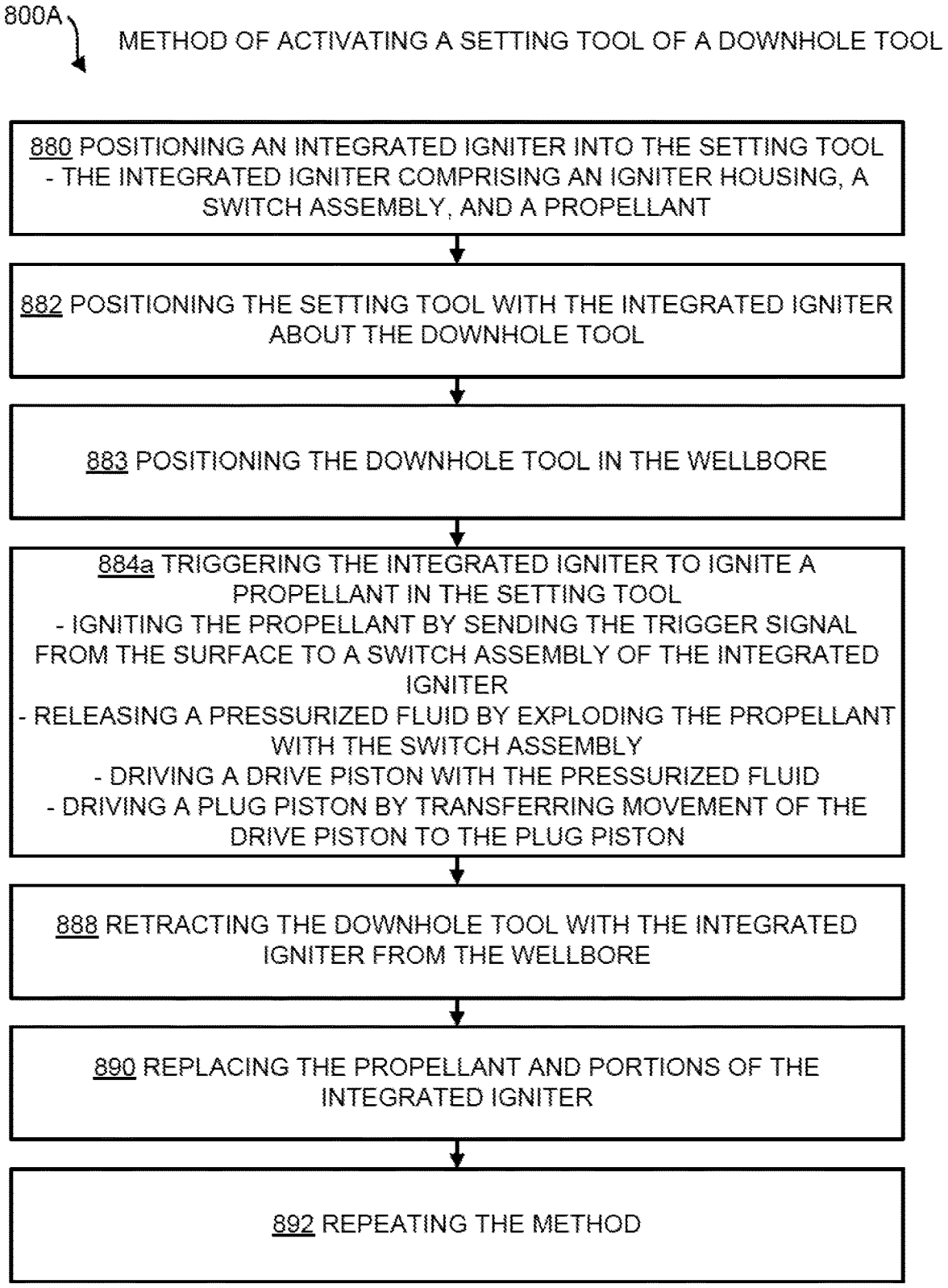
FIGS. 8A and 8B are flow charts depicting a method of activating the setting tool of a downhole tool and a method of setting a downhole component of a downhole tool, respectively.
Figure 8B:
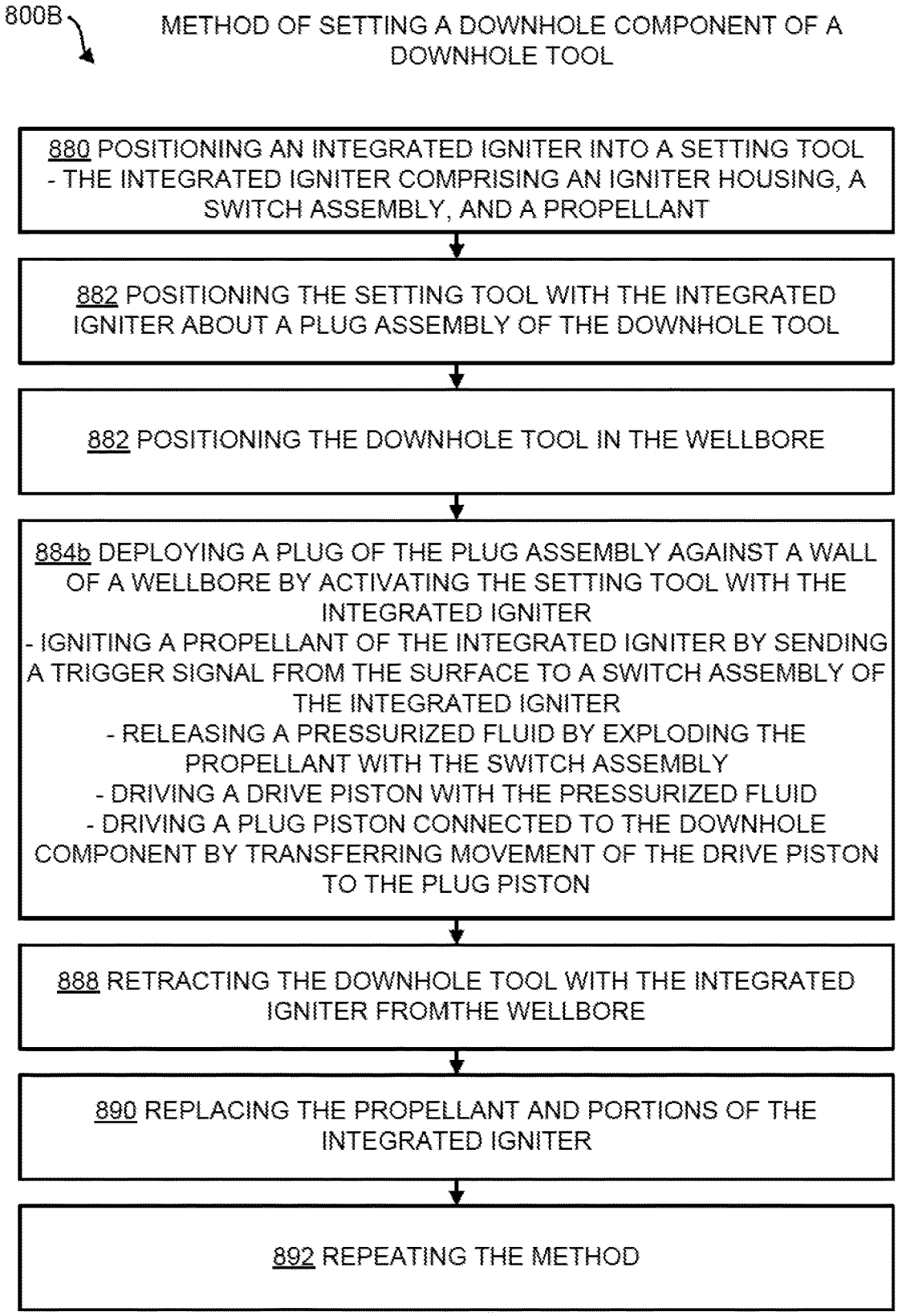

FIGS. 8A and 8B are flow charts depicting a method 800*a* of activating the integrated setting tool and a method 800*b* of setting a downhole tool, respectively.

The method 800*a* involves 880 positioning an integrated igniter into the setting tool, 882 positioning the setting tool with the integrated igniter about the downhole tool and 883 positioning the downhole tool in the wellbore. The integrated igniter comprises an igniter housing, a switch assembly, and a propellant. The method further involves 884*a* triggering the integrated igniter to ignite a propellant in the setting tool. The 884*a* triggering may involve igniting the propellant by sending the trigger signal from the surface to the switch assembly of the integrated igniter, releasing a pressurized fluid by exploding the propellant with the switch assembly, driving a drive piston with the pressurized fluid, and driving a plug piston by transferring movement of the drive piston to the plug piston. The method 800*a* may also involve 888 retracting the downhole tool with the integrated igniter from the wellbore, 890 replacing the propellant and portions of the integrated igniter, and 892 repeating the method.

The method 800*b* of setting a downhole component of a downhole tool may involve 880 positioning an integrated igniter into a setting tool, 882 positioning the setting tool with the integrated igniter about a plug assembly of the downhole tool, 883 positioning the downhole tool in the wellbore, and 884*b* deploying a plug of the plug assembly against a wall of the wellbore by activating the setting tool with the integrated igniter. The integrated igniter comprises an igniter housing, a switch assembly, and a propellant. The 884*b* activating may involve igniting a propellant of the integrated igniter by sending a trigger signal from the surface to a switch assembly of the integrated igniter, releasing a pressurized gas by exploding the propellant with the switch assembly, driving a drive piston with the pressurized gas, and driving a plug piston connected to the downhole component by transferring movement of the drive piston to the plug piston. The method 800*b* may also involve

888 retracting the downhole tool with the integrated igniter from the wellbore, 890 replacing the propellant and portions of the integrated igniter, and 892 repeating the method.

Part or all of the methods 800*a,b* may be performed in various orders, and part or all may be repeated.

While the embodiments are described with reference to various implementations and exploitations, it will be understood that these embodiments are illustrative and that the scope of the inventive subject matter is not limited to them. Many variations, modifications, additions and improvements are possible. For example, various combinations of one or more of the features and/or methods provided herein may be used.

Plural instances may be provided for components, operations or structures described herein as a single instance. In general, structures and functionality presented as separate components in the exemplary configurations may be implemented as a combined structure or component. Similarly, structures and functionality presented as a single component may be implemented as separate components. These and other variations, modifications, additions, and improvements may fall within the scope of the inventive subject matter. For example, while certain tools and components are provided herein, it will be appreciated that various configurations (e.g., shape, order, orientation, etc.) of the tools and components herein may be used. While the figures herein depict a specific configuration or orientation, these may vary. First and second are not intended to limit the number or order.

Insofar as the description above and the accompanying drawings disclose any additional subject matter that is not within the scope of the claim(s) herein, the inventions are not dedicated to the public and the right to file one or more applications to claim such additional invention is reserved. Although a very narrow claim may be presented herein, it should be recognized the scope of this invention is much broader than presented by the claim(s). Broader claims may be submitted in an application that claims the benefit of priority from this application.

What is claimed is:

1. A setting tool for setting a downhole component of a downhole tool, comprising:

a setting housing connectable to the downhole tool, the setting housing having a passage therethrough;

a setting assembly positioned in the passage, the setting assembly comprising a drive portion and a deployment portion, the drive portion having an elongate body with a propellant chamber therein, the deployment portion having an elongate body with an opening at a driver end thereof defining a drive cavity shaped to slidingly receive an end of the drive portion therein, the deployment portion comprising a deployment end, the deployment end connectable to the downhole component for movement therewith; and an integrated igniter positioned in the propellant chamber, the integrated igniter comprising an igniter housing, a switch assembly, and an internal propellant, the switch assembly operatively connected to the internal propellant whereby, upon triggering the switch assembly, the internal propellant is ignited to release an ignition fluid under ignition pressure to move the deployment portion and the downhole component connected thereto to an activated position;

wherein the integrated igniter has an external propellant and wherein the external propellant is one of:

supported by the igniter housing and extending a distance therefrom; and positioned outside the integrated igniter and within the propellant chamber.

2. The setting tool of claim 1, wherein the setting housing comprises an integrated thread adapter and an outer chamber connected together.

3. The setting tool of claim 2, wherein the integrated thread adapter is connected to another downhole component of the downhole tool and the outer chamber is connected to the downhole component.

4. The setting tool of claim 1, wherein the drive portion comprises a propellant chamber rod, a drive piston, and a drive end, the propellant chamber rod having the propellant chamber therein shaped to receive the integrated igniter, the drive end positioned at an end of the propellant chamber rod, the drive piston slidingly movable along an outer surface of the propellant chamber rod.

5. The setting tool of claim 4, wherein the deployment portion further comprises a deployment rod and a deployment end, the deployment end connected to the deployment rod and slidably positioned within the setting housing.

6. The setting tool of claim 5, wherein the deployment rod is connected to the drive piston and is movable therewith.

7. The setting tool of claim 6, wherein the deployment rod comprises a deployment chamber and a fluid chamber connected together, the driver end of the deployment chamber connected to the drive piston, the fluid chamber connected between the deployment chamber and the deployment end.

8. The setting tool of claim 7, wherein the fluid chamber has a cushion fluid therein, the ignition pressure applied to the cushion fluid whereby the ignition pressure is reduced.

9. The setting tool of claim 7, wherein the propellant chamber rod has a vented end with perforations to allow fluid pressure in the propellant chamber rod to pass from the propellant chamber, through the drive end, and to the drive piston.

10. The setting tool of claim 1, wherein the internal propellant is positioned within the igniter housing.

11. The setting tool of claim 1, wherein:

the igniter housing comprises an igniter portion and a nose portion, the igniter portion having a switch chamber therein, the nose portion having a propellant opening therethrough;

the switch assembly is positioned in the switch chamber, the switch assembly comprising a switch movable between an untriggered and a triggered position; and the propellant is supported by the nose portion, the propellant connected to the switch and the integrated igniter thereby when the switch is moved to the triggered position whereby the propellant releases a gas through the propellant opening to activate the downhole component.

12. A downhole tool, comprising:

a downhole component; and a setting tool for setting the downhole component, the setting tool, comprising:

a setting housing connectable to the downhole tool, the setting housing having a passage therethrough;

a setting assembly positioned in the passage, the setting assembly comprising a drive portion and a deployment portion, the drive portion having an elongate body with a propellant chamber therein, the deployment portion having an elongate body with an opening at a driver end thereof defining a drive cavity shaped to slidingly receive an end of the drive portion therein, the deployment portion comprising a deployment end, the deployment end connectable to the downhole component for movement therewith; and an integrated igniter positioned in the propellant chamber, the integrated igniter comprising an igniter housing, a switch assembly, and an internal propellant, the switch assembly operatively connected to the internal propellant whereby, upon triggering the switch assembly, the internal propellant is ignited to release an ignition fluid under ignition pressure to move the deployment portion and the downhole component connected thereto to an activated position;

wherein the integrated igniter has an external propellant and wherein the external propellant is one of:

supported by the igniter housing and extending a distance therefrom; and positioned outside the integrated igniter and within the propellant chamber.

13. The downhole tool of claim 12, wherein the downhole component comprises a plugging tool.

14. The setting tool of claim 13, wherein the plugging tool comprises a plug tube and a plug, the plug tube connected to the driver end, the plug radially expandable from the plug tube and against a wall of a wellbore whereby a portion of the wellbore is sealed.

15. The downhole tool of claim 12, wherein the external propellant is positioned in the propellant chamber about a nose portion of the integrated igniter.

16. The downhole tool of claim 15, wherein the external propellant comprises one of stacked discs and a solid member.

17. A method of setting a downhole component of a downhole tool, comprising:

positioning an integrated igniter into a setting tool, the integrated igniter comprising an igniter housing, a switch assembly, and a propellant;

positioning the setting tool about a plugging tool of the downhole tool;

positioning the downhole tool in a wellbore; and deploying a plug against a wall of a wellbore by activating the setting tool with the integrated igniter by:

sending a trigger signal from the surface to the switch assembly such that the propellant is ignited and releases pressurized fluid into the setting tool thereby shifting the setting tool and the plugging tool connected thereto to an activated position;

wherein the integrated igniter has an external propellant and wherein the external propellant is one of:

supported by the igniter housing and extending a distance therefrom; and positioned outside the integrated igniter and within a propellant chamber of the setting tool.

18. The method of claim 17, further comprising:

driving a drive piston with the pressurized fluid, and driving a plug piston by transferring movement of the drive piston to the plug piston.

19. The method of claim 17, further comprising retracting the downhole tool with the integrated igniter from the wellbore.

20. The method of claim 17, further comprising replacing the propellant and portions of the integrated igniter.

21. The method of claim 17, further comprising releasing a pressurized gas by exploding the propellant within the setting tool.

22. The method of claim 21, further comprising: upon igniting the propellant, driving a drive piston with the pressurized gas, and driving a plug rod connected to the setting tool by transferring movement of the drive piston to a plug piston of the plug.

* * * * *